US005625117A

United States Patent [19]

Henderson et al.

[11] Patent Number: 5,625,117

[45] Date of Patent: Apr. 29, 1997

[54] FUEL GAS STRIPPING OF RICH AMINE TO REMOVE HYDROCARBONS

[75] Inventors: Gerald O. Henderson; William M. Rice, both of Ashland, Ky.; Ric T. Zima, Huntington, W. Va.

[73] Assignee: Ashland Inc., Ashland, Ky.

[21] Appl. No.: 517,004

[22] Filed: Aug. 18, 1995

[51] Int. Cl.[6] ..... C07C 7/00; C10G 29/00; C10G 29/20

[52] U.S. Cl. ..... 585/860; 585/864; 585/802; 423/242.7; 208/207; 208/236

[58] Field of Search ..... 585/860, 864, 585/802; 423/242.7; 208/236, 207

[56] References Cited

U.S. PATENT DOCUMENTS

| | | | |
|---|---|---|---|
| 3,829,521 | 8/1974 | Green | 260/677 |
| 4,123,505 | 10/1978 | Williamson | 423/564 |
| 4,145,192 | 3/1979 | Beise et al. | 55/32 |
| 4,529,411 | 7/1985 | Goddin, Jr. et al. | 55/16 |
| 4,609,537 | 9/1986 | Tolpin et al. | 423/244 |
| 4,617,175 | 10/1986 | Tolpin et al. | 422/171 |
| 4,741,884 | 5/1988 | Carter et al. | 422/171 |
| 4,831,203 | 5/1989 | Owen et al. | 585/519 |
| 4,831,204 | 5/1989 | Kushnerick et al. | 585/519 |
| 4,831,205 | 5/1989 | Krambeck et al. | 585/519 |
| 4,966,680 | 10/1990 | Avidan et al. | 208/71 |
| 5,009,767 | 4/1991 | Bartilucci et al. | 208/85 |

*Primary Examiner*—Glenn A. Caldarola
*Assistant Examiner*—In Suk Bullock
*Attorney, Agent, or Firm*—Albert J. Adamcik; Richard D. Stone

[57] ABSTRACT

Minor amounts of $C_3$–$C_4$ hydrocarbons from amine absorbents used in removing $H_2S$ liquid $C_3$–$C_4$ hydrocarbon are recovered. The process features recovery of the $C_3$–$C_4$ hydrocarbon in a hydrocarbon gas from a second absorption zone where $H_2S$ is removed from the hydrocarbon gas, the hydrocarbon gas functioning as a stripping gas.

17 Claims, 1 Drawing Sheet

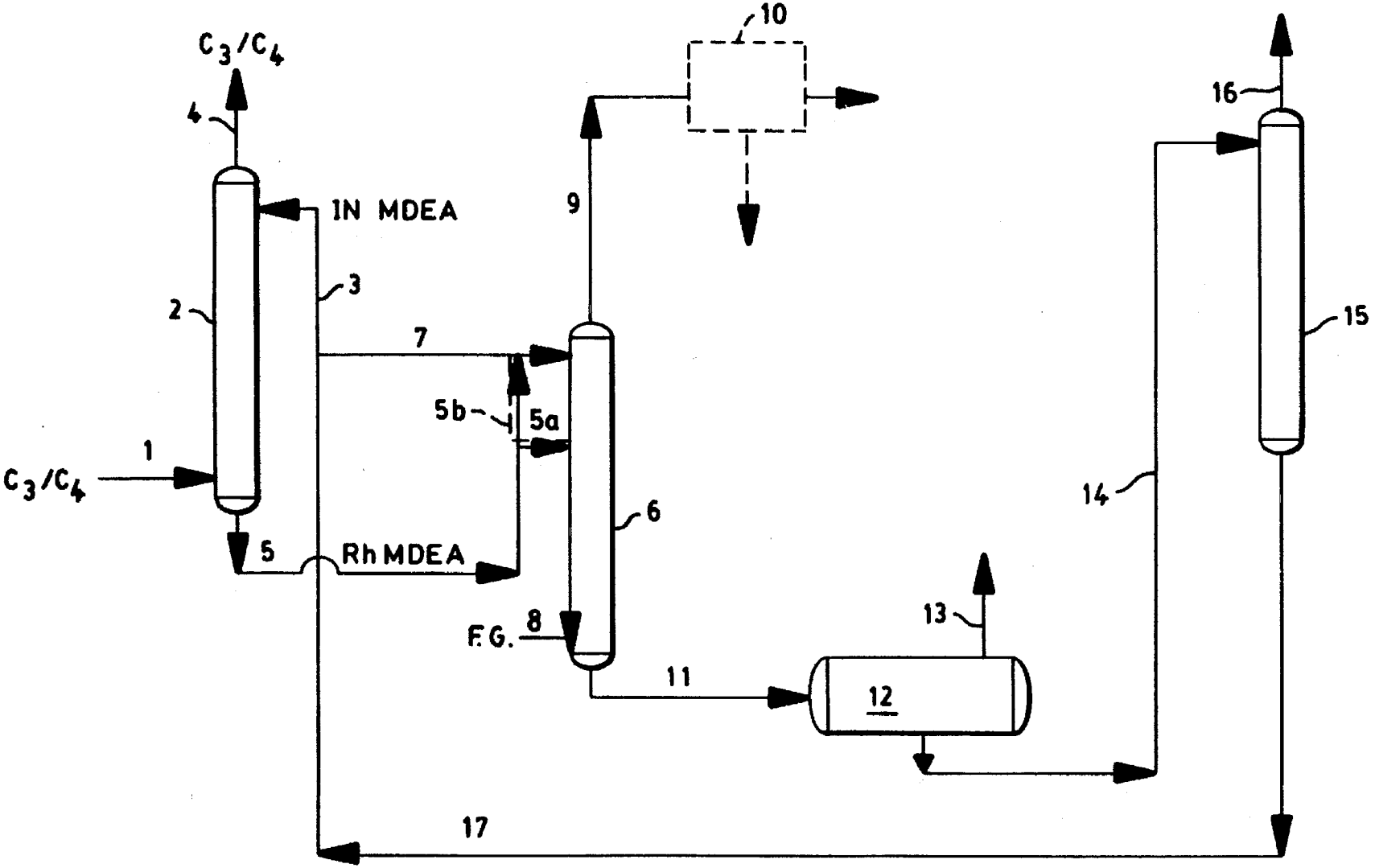
15
16
14
13
12
10
11
6
9
5a
8
F.G.
5b
7
17
IN MDEA
3
Rh MDEA
5
$C_3/C_4$
4
2
1
$C_3/C_4$

FUEL GAS STRIPPING OF RICH AMINE TO REMOVE HYDROCARBONS

BACKGROUND OF THE INVENTION

I. Field of the Invention

The invention relates to a process for recovering $C_3$–$C_4$ components absorbed by or entrained in amine absorbents during absorption removal of $H_2S$ from liquid $C_3$–$C_4$ streams.

II. Background of the Invention

Hydrocarbon streams containing or comprising significant quantities of $C_3$–$C_4$ components are common process streams in petroleum refineries and petrochemical plants. Crude processing, for example, produces a stream of mostly saturated $C_3$–$C_4$ distillate, while fluid catalytic cracking units produce a byproduct which comprises mostly $C_3$–$C_4$ unsaturates. These $C_3$–$C_4$ streams typically contain minor amounts, e.g., 0.5 to 10 percent by weight, or less, of $H_2S$, a contaminant which can seriously interfere with further processing or use of the streams. Accordingly, treatment of $C_3$–$C_4$ streams to remove $H_2S$ or reduce its concentration to a level tolerated by conversion catalysts or subsequent users is standard practice.

Commonly, the $H_2S$ is removed from such streams by procedures in which the $C_3$–$C_4$ stream is intimately contacted, under pressure sufficient to maintain the stream as a liquid, with an "absorbent" or solution comprising an amine, such as an alkanolamine. The "absorption" of the $H_2S$ from the liquid $C_3$–$C_4$ is considered to occur by a mechanism in which the $H_2S$ purportedly forms a compound with the amine at lower temperatures, this compound being readily dissociated at higher temperatures, thereby allowing "desorption" of the $H_2S$ and its further processing. Whatever the validity of the supposed mechanism, absorbency or absorption terminology has become firmly established and employed with respect to amine $H_2S$ removal, and is so employed herein. As indicated, prior art absorption of $H_2S$ from liquids and gases is well known, as exemplified in U.S. Pat. No. 4,278,621, U.S. Pat. No. 4,297,329, both by Sigmund et al, and in the literature, such as in *Gas and Liquid Sweetening*, by R. N. Maddox, Campbell Petroleum Series, 1974.

During the amine absorption treatment of liquid $C_3$–$C_4$ streams to remove $H_2S$, the slight but significant solubility of the liquid $C_3$–$C_4$ composition(s) in the amine absorbent at the pressures employed and the possible physical entrainment of the $C_3$–$C_4$ liquid in the amine may pose significant problems. A minor amount, e.g., 20 to 250 ppm, by weight, of $C_3$–$C_4$ hydrocarbon is commonly found in the amine exiting the absorber for regeneration, resulting in a significant amount of the hydrocarbon in the amine recovery system. In at least one conventional processing scheme, $C_3$–$C_4$ components in the amine have simply been allowed to flash at reduced pressure in a flash zone or drum before regenerating the amine, the flashed $C_3$–$C_4$ gas simply being sent to flare. This procedure, however, represents a net loss of $C_3$–$C_4$ hydrocarbon and increases the volume of material which must be handled by the flare. Accordingly, a need has existed for procedure for dealing with $C_3$–$C_4$ values in the rich amine that avoids the necessity for significant flaring. The invention addresses this need.

SUMMARY OF THE INVENTION

General Statement of the Invention

According to the invention, minor amounts of $C_3$–$C_4$ hydrocarbons from amine absorbents used in removing $H_2S$ from liquid $C_3$–$C_4$ hydrocarbon am recovered. The process features recovery of the $C_3$–$C_4$ hydrocarbon in a hydrocarbon gas from a second absorption zone where $H_2S$ is removed from the hydrocarbon gas, the hydrocarbon gas functioning as a stripping gas. The invention relates to a process in which a liquid $C_3$–$C_4$ hydrocarbon containing $H_2S$ is contacted with a lean amine absorbent in a first absorption zone under conditions to absorb $H_2S$ and produce a purified $C_3$–$C_4$ liquid hydrocarbon, i.e., having reduced $H_2S$ content, and a rich amine absorbent containing $H_2S$ and a minor portion of $C_3$–$C_4$ hydrocarbon, rich amine absorbent produced being processed in a novel manner to recover the $C_3$–$C_4$ hydrocarbon. As used herein, and well understood by those skilled in the art, the terms "lean" and "rich", with respect to the amine employed, are relative, merely implying, respectively, a lesser or greater degree or extent of loading or content of $H_2S$, and do not necessarily indicate or require, respectively, either that the amine is totally devoid of $H_2S$, or that it is incapable of absorbing more $H_2S$. In fact, it is preferred, as will be evident hereinafter, that the socalled "rich" amine produced in this first absorption zone retains significant or substantial residual absorptive capacity. Conversely, a "lean" amine will be understood to be capable of substantial absorption, but may have some $H_2S$ content; those skilled in the art will be aware, for example, that a regenerated "lean" absorbent will contain a quite minor concentration of $H_2S$. The terms "partially loaded" and "loaded", utilized hereinafter, are also to be understood in a similar relative sense.

Accordingly, in one embodiment of the invention, rich amine absorbent forwarded from the first absorption zone is fed to a second absorption zone, and, upon entry of rich amine absorbent into this second zone, the $C_3$–$C_4$ hydrocarbon therein is stripped therefrom by contact with a hydrocarbon gas containing $H_2S$. If the rich absorbent, upon entry, has $H_2S$ absorptive capacity remaining and $H_2S$ absorption conditions are maintained in this second zone, $H_2S$ is absorbed from the hydrocarbon gas, and depending, inter alia, on the absorptive capacity remaining and the $H_2S$ content of the gas, the rich absorbent may absorb a portion or all of the $H_2S$ in the hydrocarbon gas. If the rich amine absorbent has little or no remaining absorptive capacity, the $H_2S$ in the hydrocarbon gas may be absorbed or removed by addition of lean amine absorbent to this second zone. A purified hydrocarbon stream, i.e., one having little or no $H_2S$ content, but containing $C_3$–$C_4$ stripped from the rich absorbent, is produced, as well as a loaded absorbent containing $H_2S$ recovered in the first and second absorption zones. The loaded absorbent may be regenerated, such as by heating in a separate regeneration zone to release the $H_2S$, to permit reuse as lean absorbent in either, or both, the first absorption zone and the second absorption zone.

In an alternate embodiment, a portion of the rich amine absorbent from the first absorption zone is combined with lean amine absorbent, forming a partially or lightly loaded amine absorbent, and the partially loaded absorbent then contacts, in the second absorption or contact zone, along with at least another portion of rich amine from the first absorption zone, separately supplied to the second absorption zone, a hydrocarbon gas containing $H_2S$, under conditions to absorb $H_2S$. The contacting serves to remove the $H_2S$ from the hydrocarbon gas, while, simultaneously, the hydrocarbon gas strips the $C_3$–$C_4$ hydrocarbon from the amine absorbent(s) in the second absorption zone. Regeneration procedure in this case is similar to that of the first embodiment. In either case, the $C_3$–$C_4$ values in the hydrocarbon stream may be recovered, or, if the hydrocarbon stream is used as a fuel, the $C_3$–$C_4$ hydrocarbon may simply be used for its fuel value.

Finally, in a third option, all or substantially all of the rich amine forwarded from the first absorption zone is combined or blended with lean amine to form a partially loaded amine absorbent, the partially loaded amine absorbent being supplied to the second absorption zone where it contacts the hydrocarbon gas, forming a purified hydrocarbon gas containing $C_3$–$C_4$ hydrocarbon and a loaded amine absorbent which is regenerated.

BRIEF DESCRIPTION OF THE DRAWING

The drawing is a schematic illustration of the process flow type.

DETAILED DESCRIPTION OF THE INVENTION

As used herein, the term $C_3$–$C_4$ hydrocarbon is understood to include compositions comprising or consisting of any isomer within the specified carbon range, as well as mixtures, in all proportions, of such isomers. Thus, propane, propylene, n-butane, isobutane, butadiene, etc., either as individual streams, or normally, as mixture of such compositions, may be processed according to the invention. The $C_3$–$C_4$ hydrocarbon stream may contain a minor but significant quantity or quantities of other component(s), including compositions not classed as a hydrocarbon, provided such component(s) do not interfere with the absorption of the $H_2S$ to any substantial extent or significantly affect the amine absorbent.

The particular hydrocarbon gas utilized for stripping in the second absorption zone is largely a matter of choice, but much preferred is a fuel gas, e.g., natural gas, refinery off.gas or gases, or synfuel, or mixtures of such, which is available in a refinery or petrochemical plant. Generally, a $C_3$–$C_4$ hydrocarbon gas would not be used, but may be if the pressure of the second absorption zone is sufficiently low. The hydrocarbon stripping gas may contain, as in the case of the $C_3$–$C_4$ hydrocarbon, other gaseous components not classified as "hydrocarbon" so long as they do not interfere significantly with the $H_2S$ absorption process, degrade the amine to any great extent, or interfere with the uses to which the hydrocarbon gas and $C_3$–$C_4$ hydrocarbon, or recovered $C_3$–$C_4$ hydrocarbon, might be put.

The amine absorption process techniques and conditions employed in the respective absorption zones may be selected by those skilled in the art, and per se form no part of the invention. As mentioned, amine absorption of $H_2S$ from liquids and gases is well known in the art, and amply illustrated, for example, in the aforementioned U.S. Pat. No. 4,278,621, U.S. Pat. No. 4,297,329, and the *Gas and Liquid Sweetening* summary.

Accordingly, those skilled in the art can adjust temperatures, pressures, gas velocities, contact times, and concentrations of amine to provide the desired degree of $H_2S$ removal in each absorption zone. By way of example only, a temperature of from 5° C. to 90° C. may be utilized in either zone, with a range of from about 10° C. to about 70° C. being preferred. In many applications, such as the removal of $H_2S$ from natural gas, absorption at ambient temperatures is preferred since the cost of refrigeration would exceed the benefits obtained due to increased absorption at the lower temperature. Total contact times for the hydrocarbon gas will vary but preferably will range from about 1 second to about 30 minutes, with contact times of 5 seconds to 50 seconds being preferred. Total contact times for the $C_3$–$C_4$ liquids will preferrably range from 20 to 30 minutes.

Similarly, in the, amine regeneration or $H_2S$ stripping zone, temperatures may be varied widely. In general, temperatures of from about 90° C. to 130° C., preferably from 100° C. to 120° C., may be employed.

Pressure conditions in both absorption zones may vary substantially, with the provision that pressures in the first absorption zone are sufficient to maintain the $C_3$–$C_4$ hydrocarbon treated in the liquid phase. In the second absorption zone, pressures may vary from one atmosphere up to 100 atmospheres. Pressures of from one atmosphere to about 75 atmospheres are preferred. In the amine regeneration zone, pressures will range from about one atmosphere to about three atmospheres. As noted, the pressuretemperature relationships involved are well understood by those skilled in the art, and need not be further detailed herein.

Again, the particular amine or amines employed, generally supplied as an aqueous, amine solution, may readily be selected by those skilled in the art. Although a wide variety of amines may be employed, preferred amines are alkanolamines such as methyldiethanolamine, triethanolamine, or one or more dipropanolamines, such as dinpropanolamine or diisopropanolamine. Aqueous methyldiethanolamine, triethanolamine and dipropanolamine solutions are preferred absorbents, particularly aqueous methyldiethanolamine and diisopropanolamine solutions. Either high purity amines or technical mixtures of the amines may be used. Concentrations of aqueous alkanolamine solutions may vary widely, and those skilled in the art can adjust solution concentrations to achieve suitable absorption levels. In general, the concentration of alkanolamine in aqueous solutions will be from 5 to 60 percent, more preferebly 25 to 30 percent, by weight. The solutions may comprise a variety of additives or other components, in amounts, for example, of from 2 to 50 percent by weight. Unless otherwise specified or inconsistent with the context, all percentages by weight specified herein are based on the total weight of the mixture involved.

EXAMPLE

In order to illustrate the invention more fully, reference is made to the accompanying drawing. All values set forth hereinafter are calculated or exemplary, and the procedure illustrated is to be understood as being operated on a continuous basis.

Accordingly, a liquid $C_3$–$C_4$ hydrocarbon, typically from the overhead of a distillation unit, in line 1, enters absorption zone or scrubber 2 where it is contacted with an alkanolamine absorbent, for example, a 25 percent by weight aqueous solution of methyldiethanolamine. In this case the $C_3$–$C_4$ hydrocarbon might comprise a propane/butane mixture, e.g., 50 percent by weight of each or some similar composition. As shown, the alkanolamine absorbent is supplied to the upper level of scrubber 2 by line 3, and pressure in the scrubber is maintained at, e.g., 8.5 atm (150 psig) to 17 atm (250 psig). In scrubber 2, the $H_2S$ is absorbed tom the liquid $C_3$–$C_4$, perhaps according to the mechanism mentioned previously, and a purified liquid $C_3$–$C_4$ stream, i.e., one from which $H_2S$, and any COS possibly present, have been removed, exits the scrubber via line 4. Aqueous alkanolamine absorbent containing $H_2S$ (rich amine absorbent) and solubilized and possibly entrained $C_3$–$C_4$ hydrocarbon is removed from the bottom of scrubber 2 via line 5 and is sent, according to the invention, to second absorption zone or scrubber 6. The withdrawal rate of rich amine absorbent is regulated so that the rich amine has an $H_2S$ loading of about 0.25 mole of $H_2S$ per mole of the MDEA, indicating additional $H_2S$ absorptive capacity remaining in the draw.

Preferably, scrubber 6 is a large scrubbing unit which is employed, for example, in scrubbing fuel gas, e.g., natural gas, for a large chemical or refine complex. The advantage of the choice of such a unit is threefold: first, pressure differential between the two scrubbing units may insure good stripping of the $C_3$–$C_4$; second, the size differential between the units may be such that a relatively small rich amine stream may be stripped by a large volume of hydrocarbon gas in a large contacting zone; and, third, if the $C_3$–$C_4$ hydrocarbon stripped is to be used as fuel, it is thus combined with a fuel stream. Moreover, if the $C_3$–$C_4$ hydrocarbon is to be recovered, it may be readily recovered from a fuel stream by known procedures.

In any event, the rich amine in line 5 may be fed wholly to scrubber 6 via line 5*a*, or it may optionally be partly blended with lean alkanolamine in line 7. In the latter case, part of the rich amine stream may be fed into the scrubber via line 5*a*, and part may be blended with lean amine in line 7 via line 5*b* (dotted line) and fed to scrubber 6. Alternately, all of the rich amine in line 5 may be blended with lean alkanolamine in line 7 via line 5*b* to form a partially loaded stream which is preferably fed to the top of scrubber 6. Whatever the case, alkanolamine having some residual absorptive capacity and containing $C_3$–$C_4$ hydrocarbon enters scrubber 6 where it is stripped by a hydrocarbon gas, such as natural gas or refinery fuel gas, supplied via line 8, to remove the $C_3$–$C_4$ hydrocarbon. Flow rates, pressure, and temperatures in absorber 6 are set such that they enable good $H_2S$ removal and also permit the desired stripping of the $C_3$–$C_4$ hydrocarbon. Typically, pressure may be 4 to 6 atomspheres (60 to 90 psig), and the temperature at or about 52°C. The relatively small volume of $C_3$–$C_4$ hydrocarbon stripped does not significantly affect the $H_2S$ absorption in scrubber 6. A gas stream comprised of the purified hydrocarbon gas and the stripped $C_3$–$C_4$ hydrocarbon is removed from scrubber 6 via line 9. The $C_3$–$C_4$ hydrocarbon may optionally be recovered, e.g., by cooling, in an optional cooling zone or heat exchanger 10, or preferably may be simply be used as fuel.

Loaded amine which contains $H_2S$ from the first and second absorption zones is removed from the lower portion of the second absorption zone (scrubber 6) and forwarded via line 11 to a flash zone or drum 12 where any very slight remaining hydrocarbons absorbed in scrubber 6 are flashed off at reduced pressure (e.g., 0.1 to 2 atm or 3 to 30 psig). Alternately, the loaded amine may be sent without flashing directly to regeneration. Flashed mixture is sent to flare via line 13. The loaded amine is removed from zone 12 via line 14 and sent to regenerating zone 15 where the $H_2S$ is stripped from the aqueous amine absorbent according to known procedures and then removed via line 16. Regenerated or lean amine is removed from regenerator 15 via line 17, and forwarded for reuse. Line 17 supplies both line 3 and line 7 to provide lean alkanolamine for absorption of $H_2S$ in both scrubber 2 and scrubber 6.

Modifications

Specific compositions, procedures, and embodiments described are intended to be only illustrative of the invention disclosed by this specification. Variation on these compositions, methods, or embodiments are readily apparent to a person of skill in the art based on the teachings of this specification and are therefore intended to be included as pan of the invention disclosed herein. The terms "zone" or "zones", as employed in the specification and claims, include, where suitable, the use of segmented equipment operated in series, or the division of one unit into multiple units because of size constraints, etc. For example, an absorption column might comprise two separate columns in which the solution from the lower portion of the first column would be introduced into the upper portion of the second column, the gaseous material from the upper portion of the first column being fed into the lower portion of the second column. Specification herein that a component is supplied or forwarded to a zone does not imply a random trans tier; those skilled in the art can introduce the liquids and hydrocarbon gas at the appropriate loci in the particular units to achieve proper contacting. For example, in most situations, lean or partially loaded amine will be introduced in the upper level of an absorption zone or tower, while a rich amine would normally be introduced at a lower level. Parallel operation of units is, of course, well within the scope of the invention.

Reference to documents made in the specification is intended to result in such patents or literature being expressly incorporated herein by reference insofar as consistent with the disclosure herein, including any patents or other literature references cited within such documents.

What is claimed is:

1. A process comprising:

a. contacting liquid $C_3$–$C_4$ hydrocarbon containing $H_2S$ with lean amine absorbent in a first absorption zone under conditions to absorb $H_2S$, and producing a purified $C_3$–$C_4$ liquid hydrocarbon and rich amine absorbent containing $H_2S$ and a minor amount of $C_{3-C4}$ hydrocarbon, said rich amine having residual $H_2S$ absorptive capacity;

b. contacting a hydrocarbon gas containing $H_2S$ in a second absorption zone with rich amine absorbent from said first absorption zone under conditions to absorb $H_2S$; and c. stripping $C_3$–$C_4$ hydrocarbon from the rich amine with said hydrocarbon gas, forming a purified hydrocarbon gas containing $C_3$–$C_4$ hydrocarbon, and a loaded amine absorbent containing $H_2S$ removed in the first absorption zone and in the second absorption zone.

2. The process of claim 1 wherein the loaded amine absorbent is regenerated to produce lean amine absorbent which is returned to the first absorption zone.

3. The process of claim 1 wherein the loaded amine absorbent is regenerated to produce lean amine absorbent which is returned to the first absorption zone and the second absorption zone.

4. The process of claim 2 wherein the hydrocarbon gas containing $H_2S$ is a fuel gas.

5. The process of claim 3 wherein the hydrocarbon gas containing $H_2S$ is a fuel gas.

6. A process comprising:

a. contacting liquid $C_3$–$C_4$ hydrocarbon containing $H_2S$ with lean amine absorbent in a first absorption zone under conditions to absorb $H_2S$ and producing a purified $C_3$–$C_4$ liquid hydrocarbon, and a rich amine absorbent containing $H_2S$ and a minor amount of $C_3$–$C_4$ hydrocarbon;

b. contacting a hydrocarbon gas containing $H_2S$ in a second absorption zone with rich amine absorbent from said first absorption zone and with lean amine absorbent under conditions to absorb $H_2S$; and c. stripping $C_3$–$C_4$ hydrocarbon from the rich amine absorbent with said hydrocarbon gas, forming a purified hydrocarbon gas containing $C_3$–$C_4$ hydrocarbon, and a loaded amine absorbent containing $H_2S$ removed in the first absorption zone and in the second absorption zone.

7. The process of claim 6 wherein the rich amine fed to the second absorption zone has residual absorptive capacity.

8. The process of claim 7 wherein the loaded amine absorbent is regenerated to produce lean amine absorbent which is returned to the first absorption zone.

9. The process of claim 7 wherein the loaded amine absorbent is regenerated to produce lean amine absorbent which is returned to the first absorption zone and the second absorption zone.

10. The process of claim 8 wherein the hydrocarbon gas containing $H_2S$ is a fuel gas.

11. The process of claim 9 wherein the hydrocarbon gas containing $H_2S$ is a fuel gas.

12. A process comprising:

a. contacting liquid $C_3$–$C_4$ hydrocarbon containing $H_2S$ with lean amine absorbent in a first absorption zone under conditions to absorb $H_2S$ and producing a purified $C_3$–$C_4$liquid hydrocarbon, and a rich amine absorbent containing $H_2S$ and a minor amount of $C_3$–$C_4$ hydrocarbon;

b. combining rich amine absorbent from said first absorption zone with lean amine absorbent, forming a partially loaded absorbent containing $C_3$–$C_4$ hydrocarbon;

c. contacting a hydrocarbon gas containing $H_2S$ in a second absorption zone with partially loaded absorbent under conditions to absorb $H_2S$, and removing $H_2S$ from said hydrocarbon gas while simultaneously stripping $C_3$–$C_4$ hydrocarbon from said partially loaded absorbent with said hydrocarbon gas, forming a purified hydrocarbon gas containing $C_3$–$C_4$ hydrocarbon and a loaded amine absorbent containing $H_2S$ removed in the first absorption zone and in the second absorption zone.

13. The process of claim 12 wherein the loaded amine absorbent is regenerated to produce lean amine absorbent which is returned to the first absorption zone and the second absorption zone.

14. The process of claim 13 wherein the hydrocarbon gas containing $H_2S$ is a fuel gas.

15. A process comprising:

a. contacting liquid $C_3$–$C_4$ hydrocarbon containing $H_2S$ with lean amine absorbent in a first absorption zone under conditions to absorb $H_2S$ and producing a purified $C_3$–$C_4$ liquid hydrocarbon, and a rich amine absorbent containing $H_2S$ and a minor amount of $C_3$–$C_4$ hydrocarbon;

b. combining rich amine absorbent from said first absorption zone with lean amine absorbent, forming a partially loaded absorbent containing $C_3$–$C_4$ hydrocarbon;

c. contacting a hydrocarbon gas containing $H_2S$ in a second absorption zone with partially loaded absorbent and with rich amine from said first absorption zone under conditions to absorb $H_2S$, and removing $H_2S$ from said hydrocarbon gas while simultaneously stripping $C_3$–$C_4$ hydrocarbon from said partially loaded absorbent and said rich amine with said hydrocarbon gas, forming a purified hydrocarbon gas containing $C_3$–$C_4$ hydrocarbon and a loaded amine absorbent containing $H_2S$ removed in the first absorption zone and in the second absorption zone.

16. The process of claim 15 wherein the loaded amine absorbent is regenerated to produce lean amine absorbent which is returned to the first absorption zone and the second absorption zone.

17. The process of claim 16 wherein the hydrocarbon gas containing $H_2S$ is a fuel gas.

* * * * *